United States Patent [19]

Dulen

[11] 4,324,962

[45] Apr. 13, 1982

[54] MEMBRANE SWITCH HAVING A PUFF INK SPACER

[75] Inventor: Edwina K. Dulen, Fox Lake, Ill.

[73] Assignee: Oak Industries Inc., Rancho Bernardo, Calif.

[21] Appl. No.: 196,446

[22] Filed: Oct. 14, 1980

[51] Int. Cl.[3] ..... H01H 3/12

[52] U.S. Cl. ..... 200/159 B; 200/5 A; 200/262

[58] Field of Search ..... 200/159 B, 5 A, 262

[56] References Cited

U.S. PATENT DOCUMENTS 3,960,044 6/1976 Nagai et al. ..... 200/159 B 4,158,115 6/1979 Parkinson et al. ..... 200/159 B

*Primary Examiner*—Willis Little

*Attorney, Agent, or Firm*—Kinzer, Plyer, Dorn & McEachran

[57] ABSTRACT

A membrane switch of the type having a substrate and a flexible membrane. Both the substrate and membrane have a set of electrical conductors formed thereon. The conductors are in facing relation and are separated by a spacer. The spacer has openings in line with switch sites of the conductors to allow electrical contact in response to pressure on the flexible membrane. The spacer is formed of puff ink.

15 Claims, 4 Drawing Figures

MEMBRANE SWITCH HAVING A PUFF INK SPACER

SUMMARY OF THE INVENTION

This invention relates to membrane switches and is particularly concerned with improved materials for forming the components of a membrane switch.

A primary object of the present invention is a spacer for a membrane switch which is formed of puff ink.

Another object is a spacer for a membrane switch which can be applied in liquid form in a single-step operation.

Another object is a spacer for a membrane switch which can be applied to a variety of substrate and membrane materials.

Another object is a material for a spacer which can be applied in liquid form in a controlled manner to provide a spacer having variable thicknesses.

Another object is a spacer material which can be applied in a single-step operation and provides a spacer having greater thickness than spacers made of prior art materials.

Another object is a spacer material having a high degree of flexibility and increased resistance to flaking at points which have to be creased.

Other objects will appear from time to time in the following specification, drawings and claims.

DESCRIPTION OF A PREFERRED EMBODIMENT

The introduction of sophisticated, relatively inexpensive electronics has reduced switch operations to the simple opening and closing of a pair of contacts, with more sophisticated switching functions being carried out by auxiliary electronics. This has led to the use of membrane switches. Membrane switches consist of a flexible membrane, usually made of plastic material, and a substrate. A set of conductors is formed on the membrane and substrate respectively. The conductors typically have a plurality of switch sites with pairs of such sites being in facing relation. An insulative spacer is disposed between the sets of conductors to normally hold them in spaced, non-contacting relation. The spacer has openings in register with the switch sites so that pressure on the membrane causes the conductor on the membrane to move through the spacer opening and into contact with the conductor on the substrate, thereby closing the switch.

In the past the spacer has been formed either as a discrete layer of plastic with holes punched in it or as a separate layer of insulative paint. Both of these forms have certain disadvantages which the present invention overcomes. The discrete plastic layer is relatively expensive in terms of material and fabrication and it also leads to registry problems when assembling a switch. These difficulties are not present when a paint spacer is used. However, it is difficult to obtain a paint spacer of the desired thickness in a single-step operation. For example, a typical membrane switch uses a polyester membrane on the order of 5 mils thick. A desirable spacer thickness is about 5 to 7 mils. It is very difficult to get a 5 mil thickness in the spacer without applying two coats. This is due to the tendency of the paint or ink used for the spacer to run and fill in the openings needed for passage of the contacts on the membrane. Furthermore, spacer thicknesses above 5 mils are required for certain applications and these can not be formed in a single-pass painting process.

The present invention overcomes these difficulties by providing a spacer formed of puff ink. Puff ink is a latex type ink with acrylonitrile added to the ink. This type of ink is available from the Union Ink Company of Ridgefield, N.J. The ink is preferably applied by a silk-screening process which will be described in more detail below. The ink can be anywhere from 2 to 3 mils thick after it is applied. After the ink is applied it is dried and cured. During the curing process the ink puffs or rises in a vertical direction so that the final thickness of the spacer can be anywhere from 5 mils to as much as an eighth of an inch. The puff ink is applied in a single-screening pass.

Figure 1:
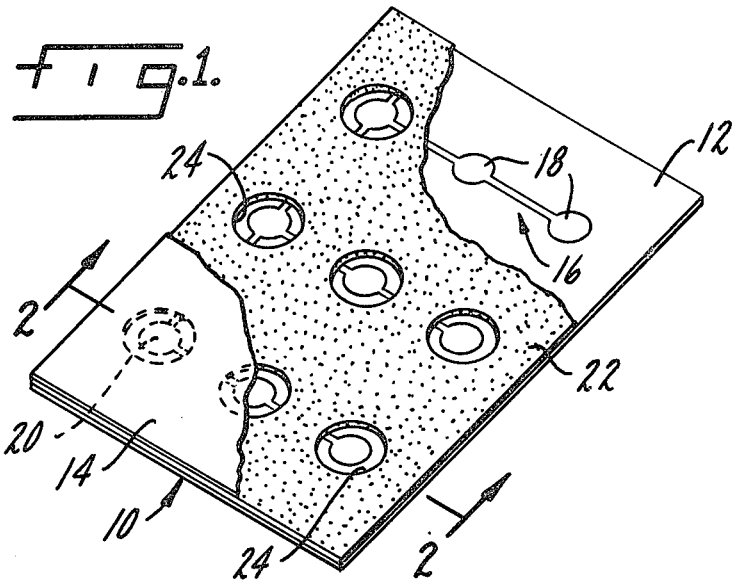
FIG. 1 is a perspective view of a membrane switch, according to the present invention, with portions cut away.
Figure 2:
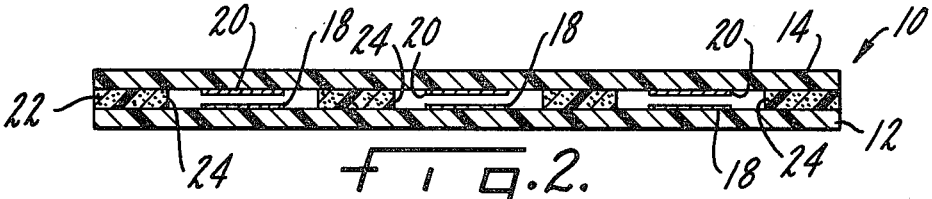
FIG. 2 is a section taken along line 2—2 of FIG. 1.

Turning to the drawings, FIG. 1 shows a typical membrane switch 10. The switch includes a substrate 12 which may be either rigid or flexible. A membrane 14 overlies the substrate. It is made of a flexible material such as polyester or polycarbonate. The substrate 12 has a first set of conductors 16, including switch sites 18 formed on its upper face. The membrane 14 also has a second set of conductors formed on its under side. This set includes a plurality of switch sites 20. It will be understood that the particular arrangement of conductors shown is for illustrative purposes only and that any arrangement of conductors could be used including an interdigitated pattern on one switch layer with a shorting bar on the opposite layer.

Intervening between the membrane and substrate is a spacer 22. The spacer has openings or holes 24 in register with the switch sites so that pressure on the exterior of the membrane will cause a switch site 20 to move through a spacer hole into contact with a switch site 18. The spacer normally holds the switch sites in spaced, non-contacting relation.

Figure 3:
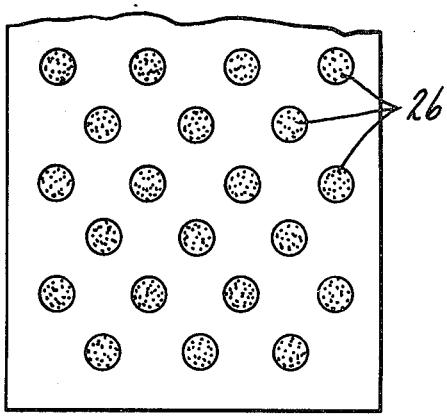
FIG. 3 is a plan view of an alternate form of a spacer.
Figure 4:
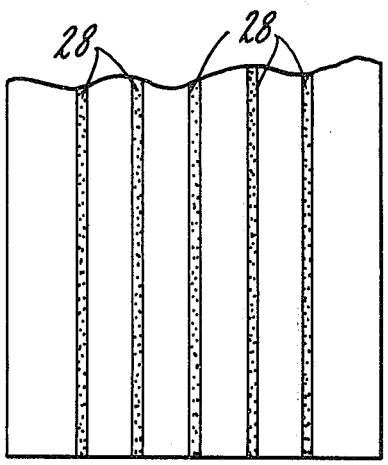
FIG. 4 is a plan view of a further alternate form of spacer.

FIGS. 3 and 4 show alternate arrangements for a spacer. In FIG. 3 the spacer takes the form of a plurality of dots 26. These may be formed on either the membrane or substrate. This corresponds to the universal spacer means described and claimed in application Ser. No. 138,656, filed Apr. 9, 1980 and assigned to the present assignee. In FIG. 4 the spacer comprises a series of lines or bars 28 which may be applied to either the membrane or substrate or possibly both. These alternate forms of a spacer are intended as illustrations of the variety of possible configurations. The invention is not to be limited to any particular spacer arrangement.

The present invention is particularly well adapted for forming complicated spacer patterns. This is because the location of the puff ink can be carefully controlled by the silk-screening application process while at the same time the requisite thickness can be obtained. The universal spacer configuration of FIG. 3 is a good example of a spacer comfiguration in which the puff ink has a decided advantage. With the puff ink spacer of the present invention a wide range of thicknesses of the spacer dots can be achieved in a single silk-screening pass. Screen printing itself does not otherwise lend itself to heavy applications of material in one pass. With conventional paint spacers the dots tend to spread out if they are initially applied in too great a thickness. This limits the thickness that can be obtained with a paint spacer.

Another advantage of the present invention is the ability to vary the ultimate spacer thickness. If the puff ink is applied by a silk-screen process the final thickness will depend on a number of factors. Among these are: the emulsion thickness on the screen, the durometer of the squeegee, the screen mesh size and the length of time between the flooding of the screen and the printing. By way of example only, it has been found that an acceptable spacer can be formed using a 60 mesh screen in a polyester monotex. A special textile waterproof emulsion supplied by Advance Process of Chicage, Ill. is preferred. The emulsion found to give good results is a white #DM333 with a diazo sensitizer #488. A single layer of this emulsion is applied to the top of the screen and several coats are applied to the bottom. A seventy durometer squeegee is preferred.

It has been found that because most of the membrane and substrate materials being used are relatively impervious to moisture, the ink must be dried before the curing process can begin. The ink is simply air dried for about ten hours at room temperature. After the drying process the ink is cured in an oven at about 100° to 200° F., with a preferred temperature of about 180° F. This heat treatment lasts for about 1 to 3 minutes.

It has been found that puff ink will sufficiently adhere to polycarbonate material. However, to obtain acceptable peel strength on polyester it is necessary to add an adhesive to the puff ink. An ethylene vinyl acetate base adhesive is preferred. Acceptable adhesives are Adcote #37JD250 and Adcote #37JD295HV, both sold by Morton Chemical Co. of Woodstock, Ill. Either one of these can be mixed with the ink in a ratio of 30% adhesive-70% ink. Also, a mixture of 10% #37JD250-10% #37JD295HV 80% puff ink has been found acceptable. The ink-adhesive mixture will also adhere suitably to the inks used in polyester graphics, i.e., the ink providing the nomenclature or indicia on the membrane.

Whereas a preferred form of the invention has been shown and described, it will be realized that many alterations and modifications could be made thereto without departing from the scope of the following claims.

I claim:

1. In a membrane switch of the type having a substrate and a flexible membrane, each having a set of conductors formed thereon, the conductors being in facing relation, and a spacer disposed between the sets of conductors to normally hold them in spaced, non-contacting relation, the spacer having openings which allow contact between the conductor sets in response to actuating pressure exerted on the switch, the improvement comprising a spacer formed of puff ink.

2. The structure of claim 1 wherein the puff ink includes an adhesive added to it to increase adherence of the spacer to either the membrane or substrate.

3. In a membrane switch of the type having a substrate and a flexible membrane, each having a set of conductors formed thereon, the conductors being in facing relation, and a spacer disposed between the sets of conductors to normally hold them in spaced, non-contacting relation, the spacer having openings which allow contact between the conductor sets in response to actuating pressure exerted on the switch, an improved method of forming the spacer comprising the steps of applying a layer of puff ink in liquid form to either the membrane or substrate, drying the puff ink and curing it to attain a desired thickness.

4. The method of claim 3 further including the step of pre-mixing adhesive with the puff ink before it is applied.

5. The method of claim 3 wherein the puff ink is applied by silk screening.

6. The method of claim 3 further characterized in that the puff ink is air dried at room temperature for about ten hours.

7. The method of claim 3 further characterized in that the puff ink is cured in an oven at about 100° F. to about 200° F. for approximately one to three minutes.

8. In a membrane switch, a substrate and a flexible membrane, each having a set of conductors formed thereon, the conductors being in facing relation, and a spacer applied, to either the membrane or substrate such that in a completed switch the spacer is between the sets of conductors to normally hold them in non-contacting relation, the spacer having openings which allow contact between the conductors sets in response to actuating pressure exerted on the switch, the improvement comprising a spacer which increases in thickness after it is applied.

9. The structure of claim 8 wherein the spacer is applied in liquid form.

10. The structure of claim 9 wherein the spacer is applied by silk screening.

11. The structure of claim 8 wherein the spacer is formed of puff ink.

12. In a method of making a membrane switch of the type having a substrate and a flexible membrane, each having a set of conductors formed thereon, the conductors being in facing relation, and a spacer applied to either the membrane or substrate such that in a completed switch the spacer is between conductors to normally hold them in spaced, non-contacting relation, the spacer having openings which allow contact between the conductor sets in response to actuating pressure exerted on the switch, including the step of applying a spacer which increases in thickness after it is applied.

13. The method of claim 12 further characterized in that the spacer is applied in liquid form.

14. The method of claim 13 wherein the spacer is applied by silk screening.

15. The method of claim 12 further characterized in that the spacer is formed of puff ink.

* * * * *